US009821592B2

(12) United States Patent
Tsutsumi et al.

(10) Patent No.: US 9,821,592 B2
(45) Date of Patent: Nov. 21, 2017

(54) SHEET

(71) Applicant: FUJI XEROX CO., LTD., Tokyo (JP)

(72) Inventors: Kojiro Tsutsumi, Kanagawa (JP); Toshiyasu Yukawa, Kanagawa (JP); Katsumi Harada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 27 days.

(21) Appl. No.: 14/602,762

(22) Filed: Jan. 22, 2015

(65) Prior Publication Data

US 2016/0089925 A1 Mar. 31, 2016

(30) Foreign Application Priority Data

Sep. 26, 2014 (JP) ..... 2014-197323

(51) Int. Cl.

| | |
|---|---|
| ***B42D 15/00*** | (2006.01) |
| ***B42D 1/00*** | (2006.01) |
| ***B42F 3/00*** | (2006.01) |
| ***B42F 13/00*** | (2006.01) |
| ***B42F 13/06*** | (2006.01) |
| ***B42F 13/36*** | (2006.01) |
| ***B65D 5/20*** | (2006.01) |

(52) U.S. Cl.

CPC ..... *B42D 15/008* (2013.01); *B42D 1/004* (2013.01); *B42D 15/0086* (2013.01); *B42F 3/003* (2013.01); *B42F 13/0006* (2013.01); *B42F 13/06* (2013.01); *B42F 13/36* (2013.01); *B65D 5/20* (2013.01); *B42P 2241/08* (2013.01); *B65D 2203/12* (2013.01)

(58) Field of Classification Search

CPC ..... B42F 3/003; B42D 1/004
USPC ..... 402/79, 14; 229/67.1; D19/75
See application file for complete search history.

(56) References Cited

U.S. PATENT DOCUMENTS

| | | | | | |
|---|---|---|---|---|---|
| 1,694,647 | A * | 12/1928 | Garfield | B41L 1/22 | 402/70 |
| 3,466,133 | A * | 9/1969 | Lennartz | B42F 3/003 | 402/14 |
| 5,389,414 | A * | 2/1995 | Popat | G09F 3/02 | 283/101 |
| 5,697,646 | A * | 12/1997 | Venegas | B42B 5/10 | 402/76 |
| 6,340,178 | B1 * | 1/2002 | Nakanishi | B42F 13/06 | 229/67.1 |
| 2007/0025808 | A1 * | 2/2007 | Penn | B42F 7/06 | 402/73 |

(Continued)

FOREIGN PATENT DOCUMENTS

| | | | |
|---|---|---|---|
| CN | 101780739 | A * | 7/2010 |
| JP | H10-71786 | A | 3/1998 |
| JP | 2000229492 | A | 8/2000 |

(Continued)

OTHER PUBLICATIONS

May 26, 2015 Office Action dated in Japanese Application No. 2014-197323.

*Primary Examiner* — Kyle Grabowski
(74) *Attorney, Agent, or Firm* — Oliff PLC

(57) ABSTRACT

A sheet includes a folding line along which the sheet is to be folded, and a mark with reference to which the sheet is placed on an image forming apparatus in a specific manner. The mark is provided in a portion that is positioned on an inner side when the sheet is folded along the folding line.

6 Claims, 10 Drawing Sheets

(56) References Cited

U.S. PATENT DOCUMENTS

2013/0320074 A1* 12/2013 Leonard ..... B42F 7/06
229/67.1

FOREIGN PATENT DOCUMENTS

JP 2006192689 A 7/2006
JP 2008-168535 A 7/2008

* cited by examiner

SHEET

CROSS-REFERENCE TO RELATED APPLICATIONS

This application is based on and claims priority under 35 USC 119 from Japanese Patent Application No. 2014-197323 filed Sep. 26, 2014.

BACKGROUND

Technical Field

The present invention relates to a sheet.

SUMMARY

According to an aspect of the invention, there is provided a sheet including a folding line along which the sheet is to be folded, and a mark with reference to which the sheet is placed on an image forming apparatus in a specific manner. The mark is provided in a portion that is positioned on an inner side when the sheet is folded along the folding line.

BRIEF DESCRIPTION OF THE DRAWINGS

Exemplary embodiments of the present invention will be described in detail based on the following figures, wherein.

DETAILED DESCRIPTION

Exemplary embodiments of the present invention will now be described with reference to the accompanying drawings.

Sheet Intended for Flat File

Figure 1:
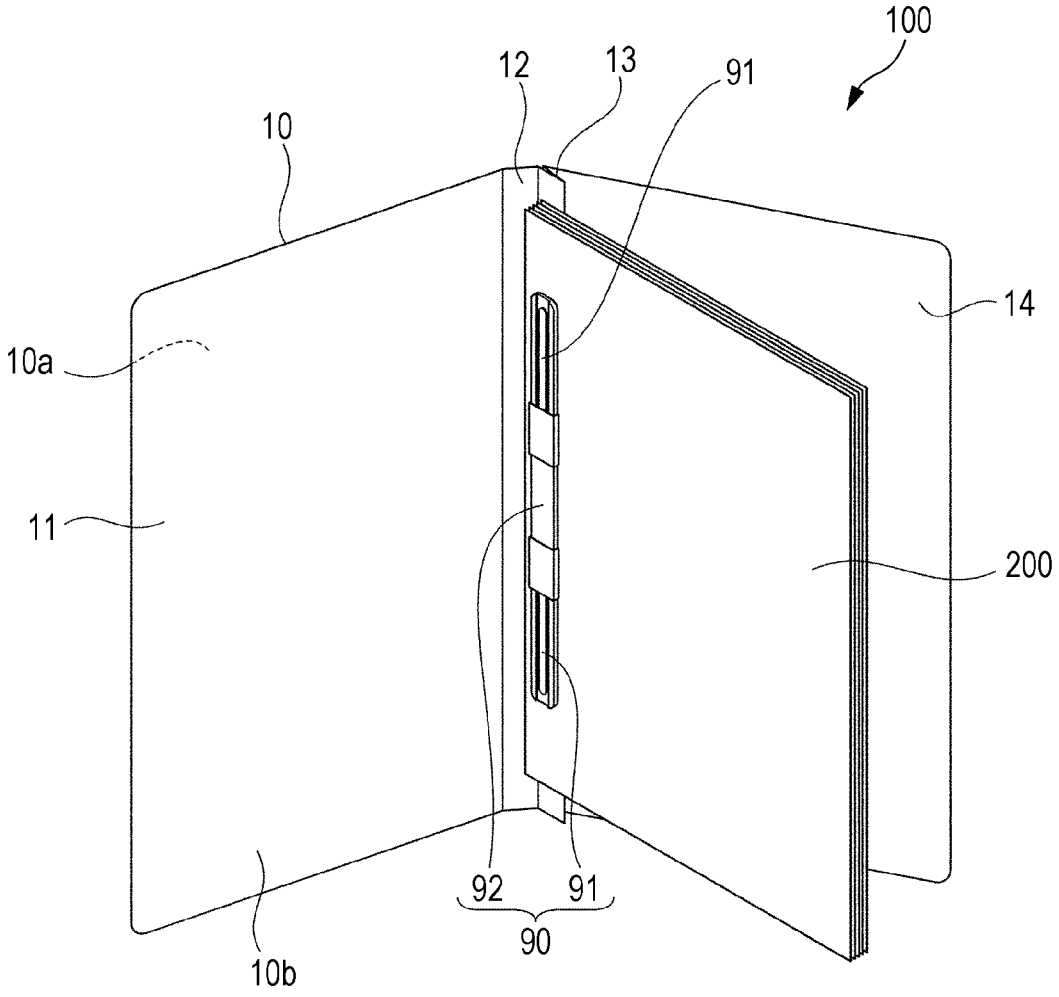
FIG. 1 is a perspective view of a flat file that is made of a sheet according to a first exemplary embodiment of the present invention.
Figure 2:
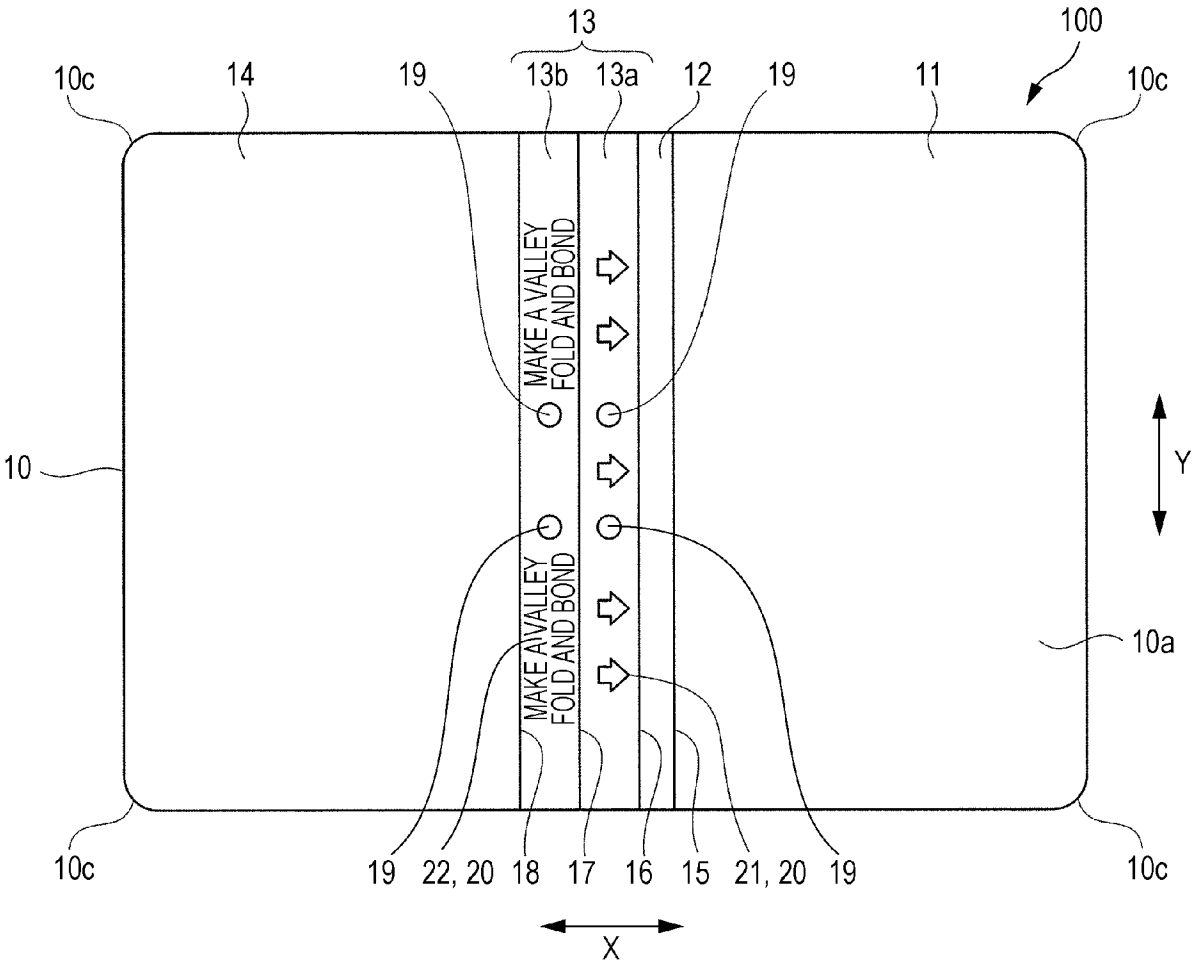
FIG. 2 is a plan view illustrating a front side of the sheet on which marks are printed in ink.

FIG. 1 is a perspective view of a flat file 100 that is made of a sheet 10 according to a first exemplary embodiment of the present invention. FIG. 2 is a plan view illustrating a front side 10*a* of the sheet 10 on which marks 20 are printed in ink.

The flat file 100 illustrated in FIG. 1 includes the sheet 10 serving as a cover when a document 200 is bound on the inner side of the flat file 100, and a binder 90 with which the document 200 is bound on the inner side of the flat file 100.

The binder 90 includes two binding strips 91 to be inserted into respective holes (not illustrated) provided in the document 200, and a fastener 92 that fastens the document 200 to the sheet 10 by holding the binding strips 91.

As illustrated in FIG. 2, the sheet 10 is, for example, a flat cardboard. The cardboard is not limited to a multilayer cardboard and may be a monolayer cardboard. Four corners 10*c* of the sheet 10 each have a round shape. The sheet 10 has plural folding lines 15, 16, 17, and 18 extending in a short-side direction Y orthogonal to a long-side direction X.

The folding lines 15, 16, and 18 are intended for mountain fold where the sheet 10 is folded in such a manner as to be convex toward the near side in FIG. 2. The folding line 17 is intended for valley fold where the sheet 10 is folded in such a manner as to be concave toward the far side in FIG. 2. When the sheet 10 in a flat state is folded along the folding lines 15, 16, 17, and 18, the sheet 10 is formed into a three-dimensional cover as illustrated in FIG. 1.

As illustrated in FIG. 2, the folding line 15 serves as a line that separates a front-cover portion 11 and a spine portion 12 from each other. The front-cover portion 11 and the spine portion 12 are to become the front cover and the spine, respectively, when the sheet 10 is folded into a three-dimensional shape (see FIG. 1). The folding line 16 serves as a line that separates the spine portion 12 and an attaching portion 13 from each other. The binder 90 is to be attached to the attaching portion 13. The folding line 18 serves as a line that separates the attaching portion 13 and a back-cover portion 14 from each other. The back-cover portion 14 is to become the back cover.

The attaching portion 13 includes a first attaching portion 13*a* adjoining the spine portion 12, and a second attaching portion 13*b* adjoining the back-cover portion 14. The first attaching portion 13*a* and the second attaching portion 13*b*, which are to be superposed on each other, are separated from each other by the folding line 17 and are in line symmetry with respect to the folding line 17. When the sheet 10 is folded along the folding line 17, the first attaching portion 13*a* and the second attaching portion 13*b* face and come into contact with each other on the front side 10*a* of the sheet 10, thereby being superposed on each other. When the sheet 10 is in a three-dimensional state for use as the flat file 100, the first attaching portion 13*a* and the second attaching portion 13*b* that have been superposed on and have come into contact with each other are fixed to each other with pieces of double-sided tape, staples, or the like. In the flat file 100 illustrated in FIG. 1, the front side 10*a* of the sheet 10 faces toward the outer side while a back side 10*b* of the sheet 10 faces toward the inner side.

The first attaching portion 13*a* and the second attaching portion 13*b* each have two attaching holes 19 that are arranged side by side in the short-side direction Y. The attaching holes 19 each have a circular shape. In the state where the first attaching portion 13*a* and the second attaching portion 13*b* are superposed on each other, the two attaching holes 19 provided in the first attaching portion 13*a* coincide with the two respective attaching holes 19 provided in the second attaching portion 13*b*.

The binding strips 91 (see FIG. 1) are inserted into the respective coinciding pairs of attaching holes 19 from the side of the second attaching portion 13*b*. One end of each of the binding strips 91 has a larger diameter than the attaching holes 19. Portions of the binding strips 91 thus inserted into the attaching holes 19 stick out on the side of the first attaching portion 13*a*. The portions of the binding strips 91 are further inserted into binding holes (not illustrated) provided in the document 200 (see FIG. 1) and are held by the fastener 92 of the binder 90. Thus, the document 200 is fastened to the attaching portion 13 and is bound in the flat file 100 as illustrated in FIG. 1.

Marks Provided on Sheet

As illustrated in FIG. 2, the sheet 10 has the marks 20 with reference to which the sheet 10 is placed on an image forming apparatus 300 (see FIG. 3 to be referred to below) in a specific manner. The marks 20 are provided on, for example, the front side 10*a* of the sheet 10 in the first attaching portion 13*a* and in the second attaching portion 13*b*.

When a valley fold is made in the sheet 10 along the folding line 17, a portion of the front side 10*a* that corresponds to the first attaching portion 13*a* and a portion of the front side 10*a* that corresponds to the second attaching portion 13*b* face and come into contact with each other in such a manner as to be superposed on each other. That is, the marks 20 are provided in an area where two portions of the sheet 10 that are across the folding line 17 from each other come into contact with each other when the sheet 10 is folded along the folding line 17. Hence, in the state where the sheet 10 is folded into a three-dimensional shape, the marks 20 provided in the portion of the front side 10*a* that corresponds to the first attaching portion 13*a* and the marks 20 provided in the portion of the front side 10*a* that corresponds to the second attaching portion 13*b* are concealed between the portions that are superposed on each other and do not appear on the outer side of the flat file 100, that is, the marks 20 are not visible from the outside. In the state where the sheet 10 is folded along the folding line 15, the folding line 16, and the folding line 18 as illustrated in FIG. 1, the marks 20 provided on the front side 10*a* of the sheet 10 in the first attaching portion 13*a* and in the second attaching portion 13*b* are positioned inside the folded portion of the sheet 10.

The marks 20 are provided by printing or stamping. Specifically, the marks 20 printed on the first attaching portion 13*a* are right-pointing arrow marks 21 as exemplary symbols. The right-pointing arrow marks 21 each extend in the long-side direction X and point toward the front-cover portion 11. The marks 20 printed on the second attaching portion 13*b* are character strings 22 as other exemplary symbols each saying "MAKE A VALLEY FOLD AND BOND." The direction in which the right-pointing arrow marks 21 point corresponds to a transport direction Z in which the sheet 10 is to be transported into the image forming apparatus 300 when printing on the sheet 10 is to be performed on the image forming apparatus 300 (see FIG. 3 to be referred to below). A user places the sheet 10 on the image forming apparatus 300 with reference to the right-pointing arrow marks 21.

Figure 3:
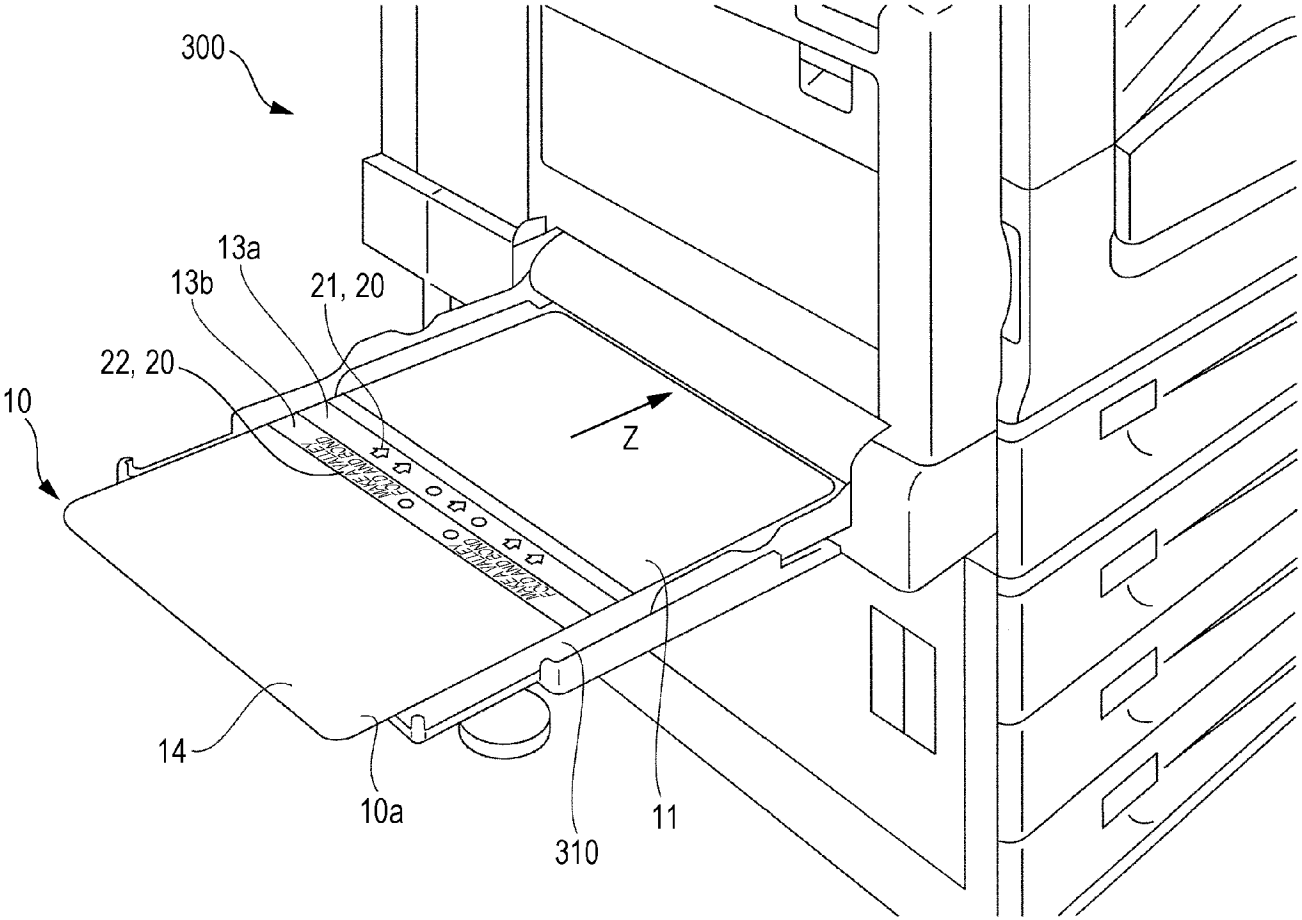
FIG. 3 schematically illustrates a state where the sheet is placed on a manual feed tray of an image forming apparatus having a function of printing image information, such as text characters, on the sheet.

FIG. 3 schematically illustrates a state where the sheet 10 is placed on a manual feed tray 310 of the image forming apparatus 300. The image forming apparatus 300 has, for example, a function of electrophotographically printing image information, such as text characters, on the sheet 10. As illustrated in FIG. 3, the sheet 10 that is still flat without being folded along the folding lines 15, 16, 17, and 18 (see FIG. 2) is placed on the manual feed tray 310 and is transported in the transport direction Z by the image forming apparatus 300. Then, the image forming apparatus 300 performs printing on a side of the sheet 10 that has been facing up on the manual feed tray 310 and has been transported in the transport direction Z.

The image forming apparatus 300 performs printing on the front side 10*a* of the sheet 10 in at least one of the front-cover portion 11, the spine portion 12, and the back-cover portion 14. Exemplary pieces of information to be printed on the sheet 10 include the title, the author name, the provider name, the addressee, and the like of the document 200 (see FIG. 1) to be bound in the flat file 100; and images such as a logo and photos.

To place the sheet 10 on the manual feed tray 310 of the image forming apparatus 300, the user needs to know on which side of the sheet 10 printing is to be performed and also needs to place the sheet 10 correctly. The image forming apparatus 300 illustrated in FIG. 3 is configured such that printing is performed on a side of the sheet 10 that faces up on the manual feed tray 310. Therefore, the marks 20 prompt the user to place the sheet 10 with the front side 10*a* of the sheet 10 facing up.

To place the sheet 10 on the manual feed tray 310 of the image forming apparatus 300, the front-cover portion 11 of the sheet 10 needs to be positioned on the downstream side with respect to the back-cover portion 14 in the transport direction Z of the image forming apparatus 300. If the back-cover portion 14 is mistakenly positioned on the downstream side with respect to the front-cover portion 11 in the transport direction Z, for example, the images expected to be printed on the front-cover portion 11 are printed upside down on the back-cover portion 14.

The sheet 10 illustrated in FIG. 2 has the marks 20 on the front side 10*a* thereof. When the user is going to place the sheet 10 on the manual feed tray 310 of the image forming apparatus 300, the user is prompted by the marks 20 to place the sheet 10 with the side (the front side 10*a*) on which the marks 20 are provided facing up as illustrated in FIG. 3. Thus, the image forming apparatus 300 performs printing on the front side 10*a* of the sheet 10.

As illustrated in FIG. 2, the sheet 10 according to the first exemplary embodiment also has the right-pointing arrow marks 21 pointing in the transport direction Z. Hence, when the user is going to place the sheet 10 on the manual feed tray 310 of the image forming apparatus 300, the user is prompted by the marks 20 to place the sheet 10 such that the direction of the right-pointing arrow marks 21 corresponds to the transport direction Z of the image forming apparatus 300 as illustrated in FIG. 3. Thus, the image forming apparatus 300 performs printing on a preset portion of the sheet 10 in a preset orientation.

As described above, the sheet 10 having the marks 20 is placed on the image forming apparatus 300 in a specific manner, particularly, with a specific side of the sheet 10 facing up and in a specific orientation of the sheet 10 with respect to the transport direction Z.

In the state where the sheet 10 illustrated in FIG. 2 is folded along the folding lines 15, 16, 17, and 18, the marks 20 do not appear on the outer side of the flat file 100.

The marks 20 provided on the sheet 10 include symbols such as the right-pointing arrow marks 21 and the character strings 22. Alternatively, the marks 20 may include any other state-recognizable indications, such as patterns, helping the user recognize the orientation and the faceup side of the sheet 10.

The marks 20 may be provided on the back side 10*b* (see FIG. 1) of the sheet 10.

Figure 9A:
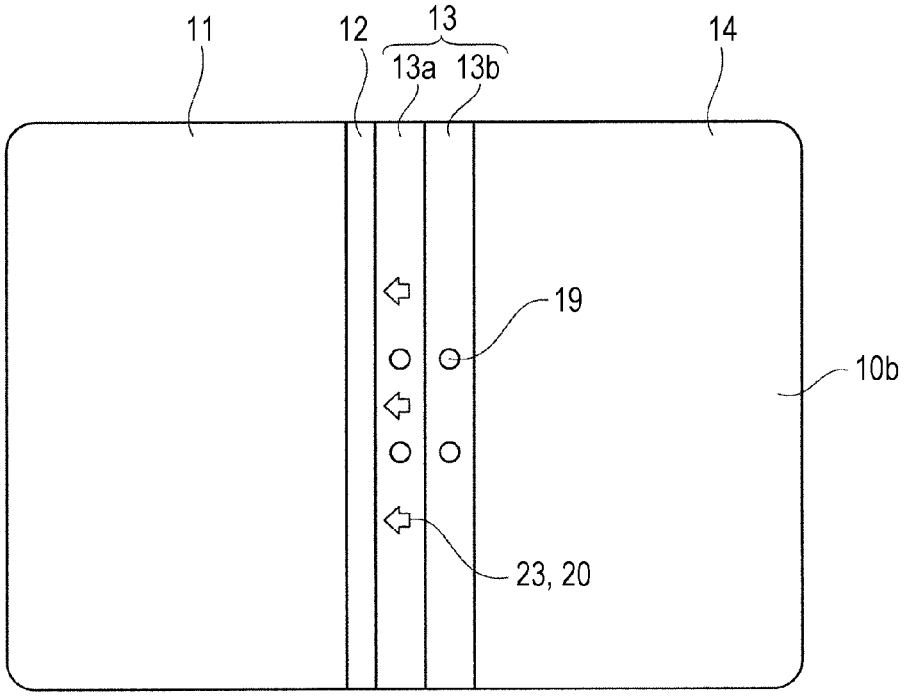
FIGS. 9A and 9B are plan views illustrating back sides of different sheets, respectively, according to the first exemplary embodiment that each have marks printed in ink.
Figure 9B:
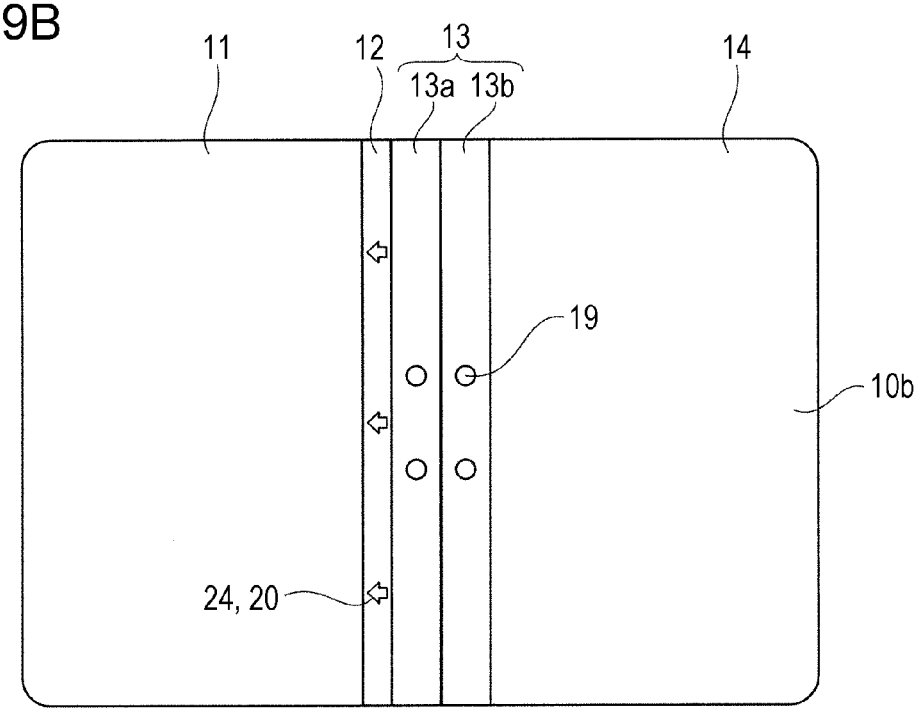

FIGS. 9A and 9B are plan views illustrating back sides 10*b* of different sheets 10, respectively, according to the first exemplary embodiment that each have marks 20 printed in ink. The front and back sides of each of the sheets 10 illustrated in FIGS. 9A and 9B are opposite to the front and back sides of the sheet 10 illustrated in FIG. 2. The marks 20 (21 and 22) illustrated in FIG. 2 are replaced with left-pointing arrow marks 23 in the case illustrated in FIG. 9A and with left-pointing arrow marks 24 in the case illustrated in FIG. 9B.

In the case illustrated in FIG. 9A, the left-pointing arrow marks 23 as the marks 20 are provided in a portion on the back side 10*b* of the sheet 10 that corresponds to the first attaching portion 13*a*. The marks 20 may alternatively be provided in a portion on the back side 10*b* of the sheet 10 that corresponds to the second attaching portion 13*b*, not in the portion corresponding to the first attaching portion 13*a*, or may be provided both in the portion corresponding to the first attaching portion 13*a* and in the portion corresponding to the second attaching portion 13*b*. Although the marks 20 in each of these cases are not concealed between portions of the sheet 10 that come into contact with each other, the marks 20 are positioned on the inner side when the sheet 10 is folded as illustrated in FIG. 1.

In the case illustrated in FIG. 9B, the left-pointing arrow marks 24 as the marks 20 are provided in a portion on the back side 10*b* of the sheet 10 that corresponds to the spine portion 12. Additional marks 20 may be provided in the first attaching portion 13*a* and/or in the second attaching portion 13*b*. Although the marks 20 in such a case are not concealed either between portions of the sheet 10 that come into contact with each other, the marks 20 are positioned on the inner side when the sheet 10 is folded as illustrated in FIG. 1.

In each of the cases illustrated in FIGS. 9A and 9B, the side having no marks 20 is identified as the front side 10*a*. Therefore, for example, any indication for correctly placing the sheet 10 with reference to the marks 20 may be provided to the user through an operation manual, a control panel (not illustrated) of the image forming apparatus 300 to be operated by the user, or the like. Specifically, in the image forming apparatus 300 illustrated in FIG. 3, the sheets 10 illustrated in FIGS. 9A and 9B are each positioned such that the back side 10*b* faces down and such that the left-pointing arrow marks 23 or 24 point in the transport direction Z. In each of the cases illustrated in FIGS. 9A and 9B, when the sheet 10 is used as the flat file 100 after printing is performed on the sheet 10 by the image forming apparatus 300, the portion of the back side 10*b* of the sheet 10 that has been folded into a three-dimensional shape as the cover of the flat file 100 is positioned on the inner side between the front-cover portion 11 and the back-cover portion 14. Therefore, the marks 20 are not visible from the outer side. That is, in the state where the sheet 10 is folded along the folding lines 15, 16, 17, and 18, the marks 20 are provided on the portion that is positioned on the inner side and are not visible from the outer side.

First Modification

Figure 4A:
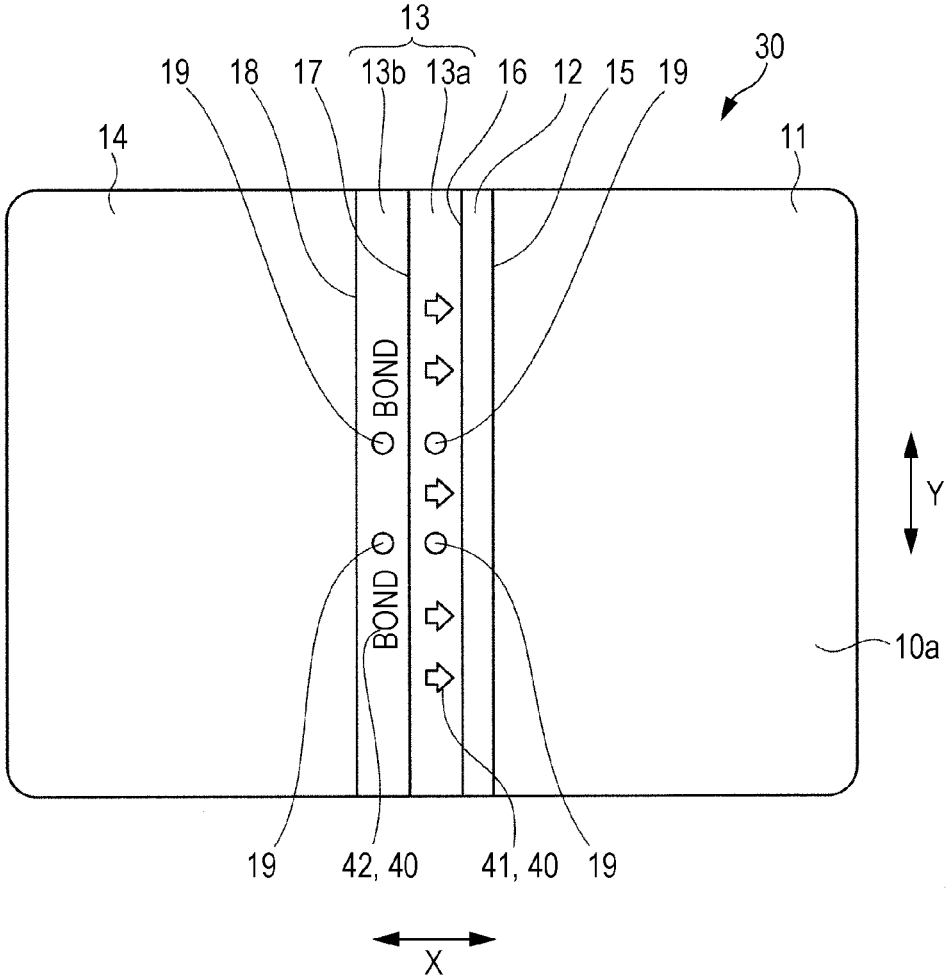
FIG. 4A is a plan view corresponding to FIG. 2 and illustrating a sheet according to a first modification of the first exemplary embodiment that has three-dimensional marks provided by pressing.
Figure 4B:
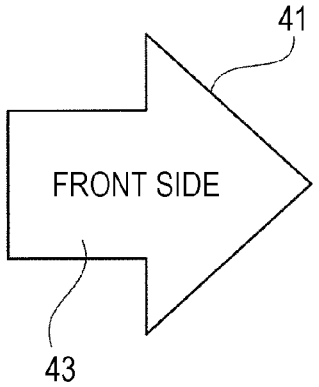
FIG. 4B is a detailed view illustrating one of right-pointing arrow marks illustrated in FIG. 4A.

FIGS. 4A and 4B illustrate a first modification of the first exemplary embodiment in which marks 40, instead of the marks 20 described with reference to FIG. 2 and FIGS. 9A and 9B, are provided three-dimensionally in a sheet 30 by pressing.

FIG. 4A is a plan view corresponding to FIG. 2 and illustrating the sheet 30 having the marks 40. FIG. 4B is a detailed view illustrating one of right-pointing arrow marks 41 illustrated in FIG. 4A. The sheet 30 is the same as the sheet 10 illustrated in FIG. 2, except that the marks 20 that are provided by printing are replaced with the marks 40 that are provided three-dimensionally by pressing. Elements of the sheet 30 that are common to those of the sheet 10 are denoted by corresponding ones of the reference numerals used for describing the sheet 10.

As illustrated in FIG. 4A, for example, the marks 40 are provided in the first attaching portion 13*a* and in the second attaching portion 13*b* so as to be recognized without fail on the front side 10*a* of the sheet 30. The marks 40 are provided three-dimensionally by pressing while applying pressure, heat, or the like. The marks 40 provided in the first attaching portion 13*a* are the right-pointing arrow marks 41 that are provided three-dimensionally. The right-pointing arrow marks 41 as exemplary symbols extend in the long-side direction X and point toward the front-cover portion 11. As illustrated in FIG. 4B, each of the right-pointing arrow marks 41 has a character string 43 saying "FRONT SIDE" and provided three-dimensionally. The character string 43 is enclosed by the outline of the right-pointing arrow mark 41. The character string 43 saying "FRONT SIDE" indicates that the side of the sheet 30 on which the character strings 43 are provided is the front side 10*a* of the sheet 30.

The marks 40 provided in the second attaching portion 13*b* are specifically three-dimensional character strings 42 as exemplary symbols. The character strings 42 each say "BOND" and indicate that the first attaching portion 13*a* and the second attaching portion 13*b* are to be bonded to each other. The marks 40 may each be a combination of printed images and three-dimensional patterns. For example, the character strings 42 may be provided as printed images, as with the marks 20.

As described above, the sheet 30 according to the first modification is placed on the image forming apparatus 300 (see FIG. 3) in a specific manner. Particularly, the side of the sheet 30 that faces up and the orientation of the sheet 30 with respect to the transport direction Z are specified.

In the state where the sheet 30 according to the first modification is folded along the folding lines 15, 16, 17, and 18, the marks 40 do not appear on the outside. More specifically, since the first attaching portion 13*a* and the second attaching portion 13*b* are superposed on each other, the marks 40 are concealed between the first attaching portion 13*a* and the second attaching portion 13*b* that are in contact with each other and do not therefore appear on the outside. In the state where the sheet 30 is folded as illustrated in FIG. 1, the area where the first attaching portion 13*a* and the second attaching portion 13*b* are superposed on each other is positioned on the inner side between the front-cover portion 11 and the back-cover portion 14.

The marks 40 may alternatively be provided on the back side 10*b* (see FIG. 1) of the sheet 30. In that case, the side of the sheet 30 on which no marks 40 are provided is identified as the front side 10*a*. The back side 10*b* of the sheet 30 folded three-dimensionally into the flat file 100 faces toward the space between the front-cover portion 11 and the back-cover portion 14. Therefore, the marks 40 are concealed on the inner side and are not visible from the outside.

Second Modification

Figure 5A:
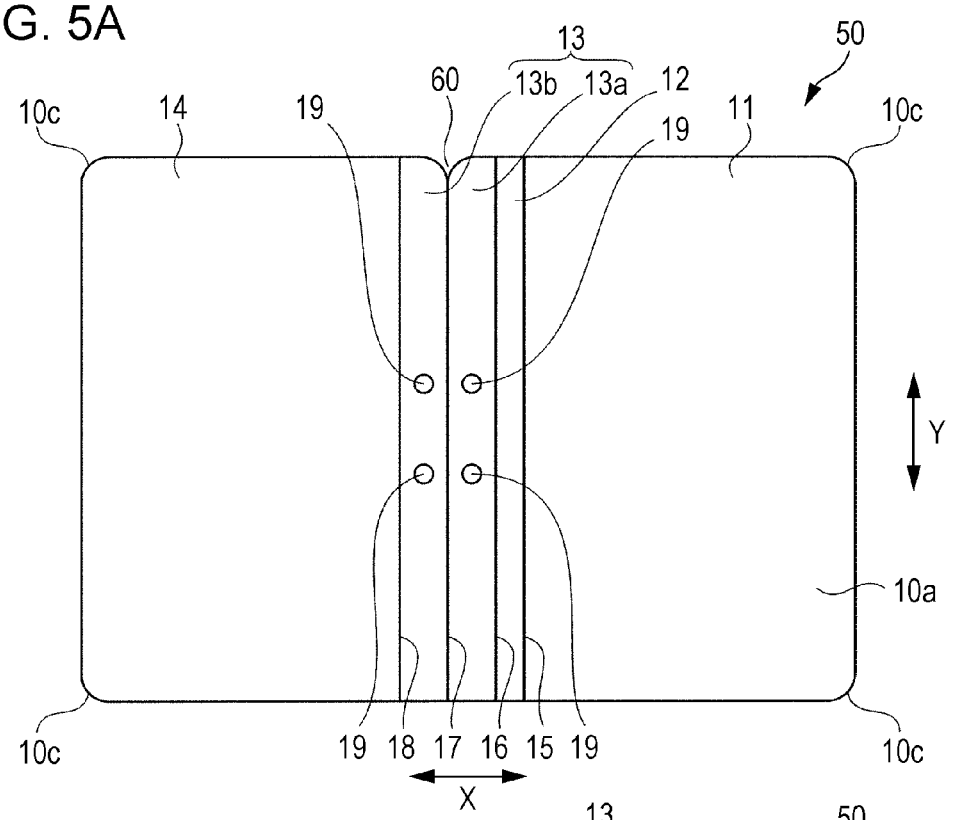
FIGS. 5A and 5B are plan views corresponding to FIG. 2 and illustrating a front side and a back side, respectively, of a sheet according to a second modification of the first exemplary embodiment that has a mark provided as a notch.
Figure 5B:
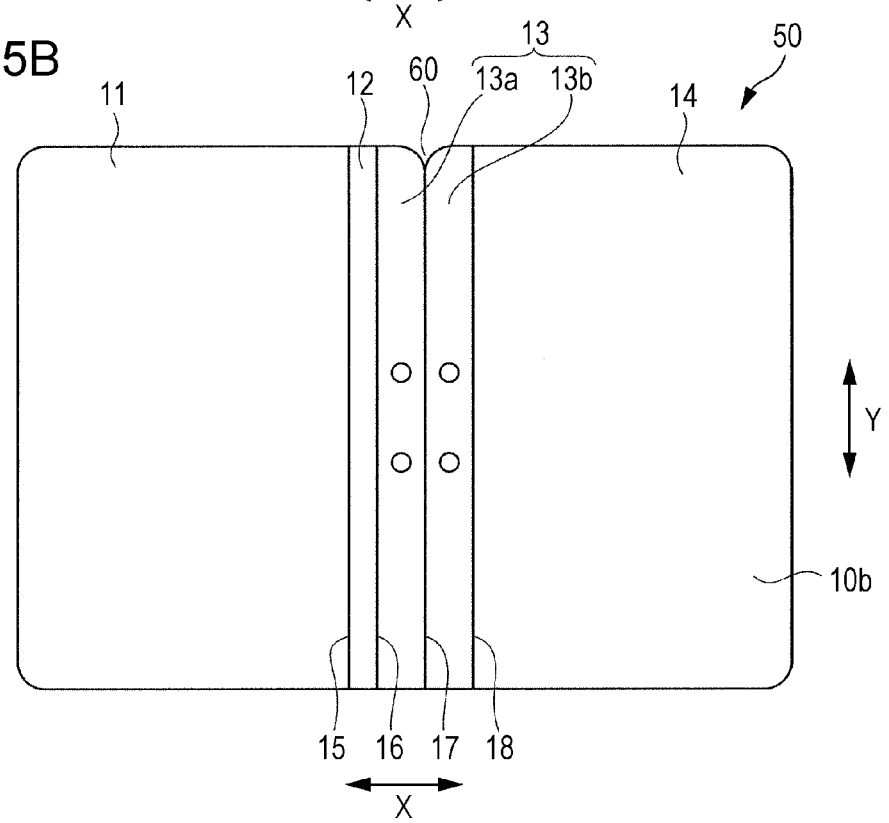

FIGS. 5A and 5B are plan views corresponding to FIG. 2 and illustrating a sheet 50 according to a second modification of the first exemplary embodiment that has a mark 60 provided as a notch, instead of the marks 20 (see FIG. 2) printed in ink or the marks 40 (see FIGS. 4A and 4B) provided three-dimensionally by pressing. FIG. 5A illustrates the front side 10*a*. FIG. 5B illustrates the back side 10*b*. The sheet 50 is the same as the sheet 10 illustrated in FIG. 2, except that the marks 20 are replaced with the mark 60. Elements of the sheet 50 that are common to those of the sheet 10 are denoted by corresponding ones of the reference numerals used for describing the sheet 10.

As illustrated in FIGS. 5A and 5B, the mark 60 is, for example, a notch provided in the upper side, in FIGS. 5A and 5B, of the sheet 50 and over the first attaching portion 13*a* and the second attaching portion 13*b* and having a line-symmetrical shape with respect to the folding line 17. The mark 60 has round corners that are formed by the same method as the method of forming the four round corners 10*c* of the sheet 50.

The mark 60 is centered on the folding line 17. Referring to FIG. 5A, in the state where the front side 10*a* of the sheet 50 faces up (toward the near side in FIG. 5A) with the mark 60 being positioned on the upper side of the sheet 50, two folding lines 15 and 16 are positioned to the right of the mark 60 while one folding line 18 is positioned to the left of the mark 60.

Referring to FIG. 5B, in a state where the back side 10*b* of the sheet 50 faces up (toward the near side in FIG. 5B) with the mark 60 being positioned on the upper side of the sheet 50, one folding line 18 is positioned to the right of the mark 60 while two folding lines 15 and 16 are positioned to the left of the mark 60.

Hence, to place the sheet 50 having the mark 60 on the image forming apparatus 300 (see FIG. 3), the mark 60 is positioned on the upper side while two folding lines (the folding lines 15 and 16) are positioned to the right of the mark 60 as illustrated in FIG. 5A. Thus, the sheet 50 is placed on the image forming apparatus 300 as specified.

Furthermore, according to the second modification, in the state where the sheet 50 is folded along the folding lines 15, 16, 17, and 18, the mark 60 is positioned on the inner side and does not appear on the outer side. That is, the mark 60 is not likely to be visible from the outside.

The placement of the sheet 50 (the side of the sheet 50 that faces up and the orientation of the sheet 50 when transported) according to the second modification is specified on the basis of the positional relationship between the mark 60 and the folding lines 15, 16, and 18. Alternatively, plural marks 60 may be provided, and the placement of the sheet 50 may be specified on the basis of the positional relationship among the plural marks 60.

Figure 6:
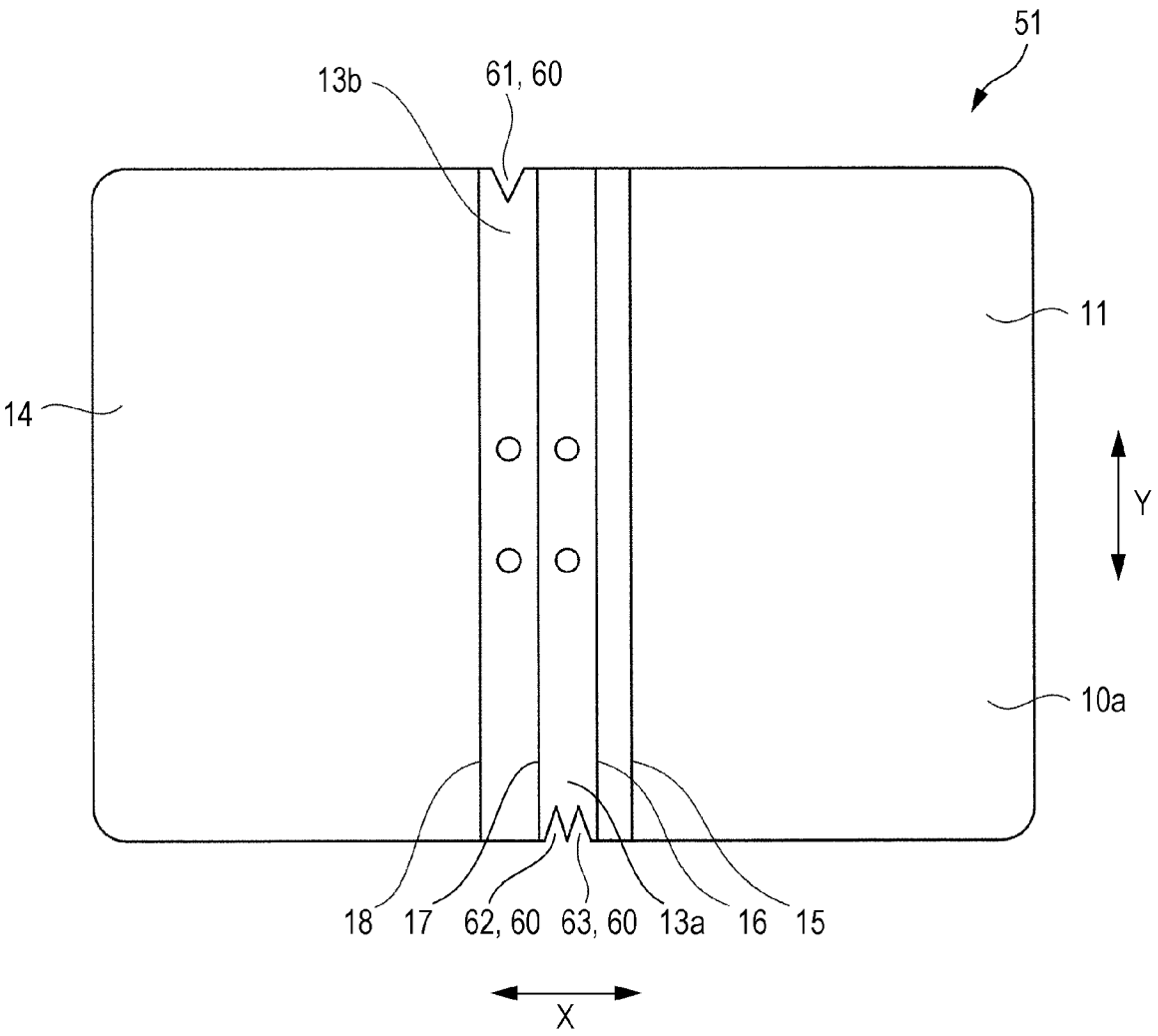
FIG. 6 is a plan view corresponding to FIG. 2 and illustrating another sheet according to the second modification of the first exemplary embodiment that has one mark on an upper one of two sides thereof that extend in a long-side direction and two marks on a lower side thereof.

FIG. 6 is a plan view corresponding to FIG. 2 and illustrating a sheet 51 according to the second modification that has one mark 60 on one of the two sides (the upper side in FIG. 6) extending in the long-side direction X and two marks 60 on the other side (the lower side in FIG. 6). The mark 60 on the upper side in FIG. 6 is a notch 61. The marks 60 on the lower side in FIG. 6 are notches 62 and 63. The notch 61 on the upper side is provided in the second attaching portion 13*b*. The notches 62 and 63 on the lower side are provided in the first attaching portion 13*a*. The position of the notch 61 and the position of a set of the notches 62 and 63 are different from each other, and different numbers of notches are provided at different positions.

To place the sheet 51 described above on the image forming apparatus 300 (see FIG. 3), the sheet 51 is oriented such that, as illustrated in FIG. 6, the one notch 61 is positioned on the upper side, and the two notches 62 and 63 are positioned on the lower side and to the right of the one notch 61 on the upper side. Thus, the faceup side and the orientation of the sheet 51 are determined as specified, and printing is performed on the front side 10*a* of the sheet 51 as intended.

Hence, the sheet 51 according to the second modification is placed with the faceup side and the orientation thereof with respect to the image forming apparatus 300 being determined as specified. Consequently, the sheet 51 is positioned on the image forming apparatus 300 as predetermined.

Furthermore, folding the sheet 51 according to the second modification along the folding line 17 such that the first attaching portion 13*a* and the second attaching portion 13*b* are superposed on each other means superposing the portion having the notch 61 and the portion having the notches 62 and 63 on each other. Therefore, the marks 60 (the notches 61, 62, and 63) are not likely to be visible from the outside. Furthermore, in the state where the sheet 51 is folded along the folding lines 15, 16, 17, and 18, the marks 60 (the notches 61, 62, and 63) are positioned on the inner side. Therefore, the marks 60 (the notches 61, 62, and 63) do not appear on the outer side.

The marks 60 as the notches 61, 62, and 63 are not limited to be in contact with the upper side and the lower side of the sheet 51 and may be through holes, as with the attaching holes 19. Furthermore, the notches 61, 62, and 63 do not necessarily have the same shape and may have different shapes and be provided at different positions so that the faceup side and the orientation of the sheet 51 are determined as specified.

Third Modification

Figure 7:
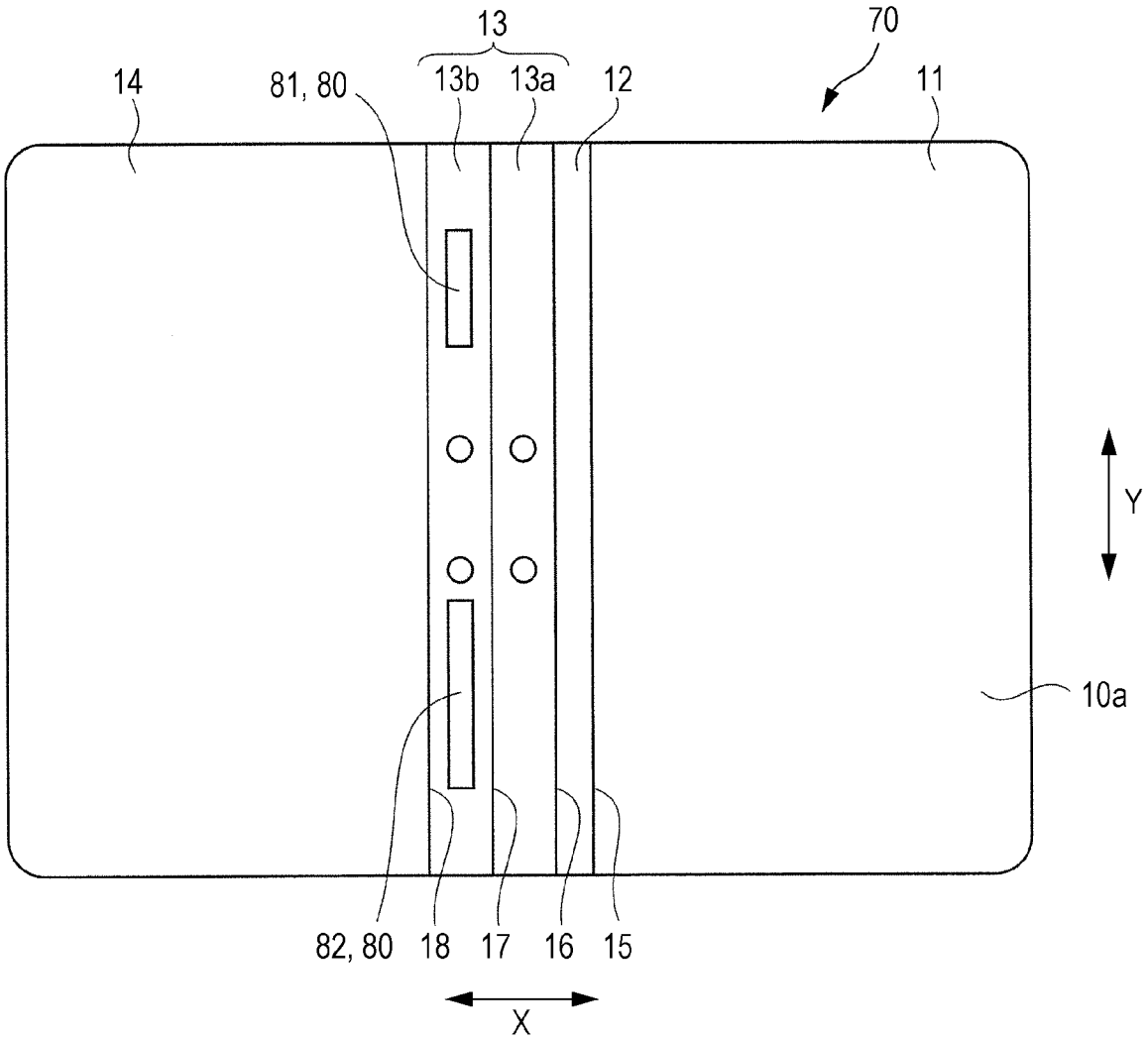
FIG. 7 is a plan view corresponding to FIG. 2 and illustrating a sheet according to a third modification of the first exemplary embodiment that has marks provided as additional members.

FIG. 7 is a plan view corresponding to FIG. 2 and illustrating a sheet 70 according to a third modification of the first exemplary embodiment that has marks 80 provided as additional members, instead of the marks 20 (see FIG. 2) printed in ink, the marks 40 (see FIGS. 4A and 4B) provided three-dimensionally by pressing, or the marks 60 (see FIGS. 5A, 5B, and 6) provided as notches. The sheet 70 is the same as the sheet 10 (see FIG. 2), except that the marks 20 are replaced with the marks 80. Therefore, elements of the sheet 70 that are common to those of the sheet 10 are denoted by corresponding ones of the reference numerals used for describing the sheet 10.

As illustrated in FIG. 7, the marks 80 are, for example, pieces of double-sided tape 81 and 82 pasted on the front side 10*a* of the sheet 70 in the second attaching portion 13*b* and provided for bonding the first attaching portion 13*a* and the second attaching portion 13*b* that are to be superposed on each other. One side of each of the pieces of double-sided tape 81 and 82 is adhering to the second attaching portion 13*b*, while the other side that is to adhere to the first attaching portion 13*a* is covered with a piece of release paper.

Referring to FIG. 7, the piece of double-sided tape 81 pasted near the upper side of the sheet 70 is shorter than the piece of double-sided tape 82 pasted near the lower side of the sheet 70.

The sheet 70 according to the third modification described above is to be placed on the image forming apparatus 300 with the side (front side 10*a*) on which the pieces of double-sided tape 81 and 82 are pasted facing up (toward the near side in FIG. 7) and with the piece of double-sided tape 81, the relatively short one, being positioned nearer to the upper side than the piece of double-sided tape 82, the relatively long one. Thus, printing is performed on the sheet 70 according to the third modification with predetermined settings made on the image forming apparatus 300.

Hence, in the third modification, the faceup side and the orientation of the sheet 70 with respect to the image forming apparatus 300 are determined as specified. Consequently, the sheet 70 is placed on the image forming apparatus 300 as specified.

In the third modification, the sheet 70 is folded along the folding lines 15, 16, 17, and 18 with the pieces of release paper on the respective pieces of double-sided tape 81 and 82 being removed, whereby the pieces of double-sided tape 81 and 82 adhere to the first attaching portion 13*a*. Consequently, the first attaching portion 13*a* and the second attaching portion 13*b* that have been superposed on each other are fixed to each other with the pieces of double-sided tape 81 and 82.

Furthermore, since the first attaching portion 13*a* and the second attaching portion 13*b* are fixed to each other while being in contact with each other, the pieces of double-sided tape 81 and 82 do not appear on the outside even if the cover of the resulting flat file 100 illustrated in FIG. 1 is opened.

Fourth Modification

Figure 8:
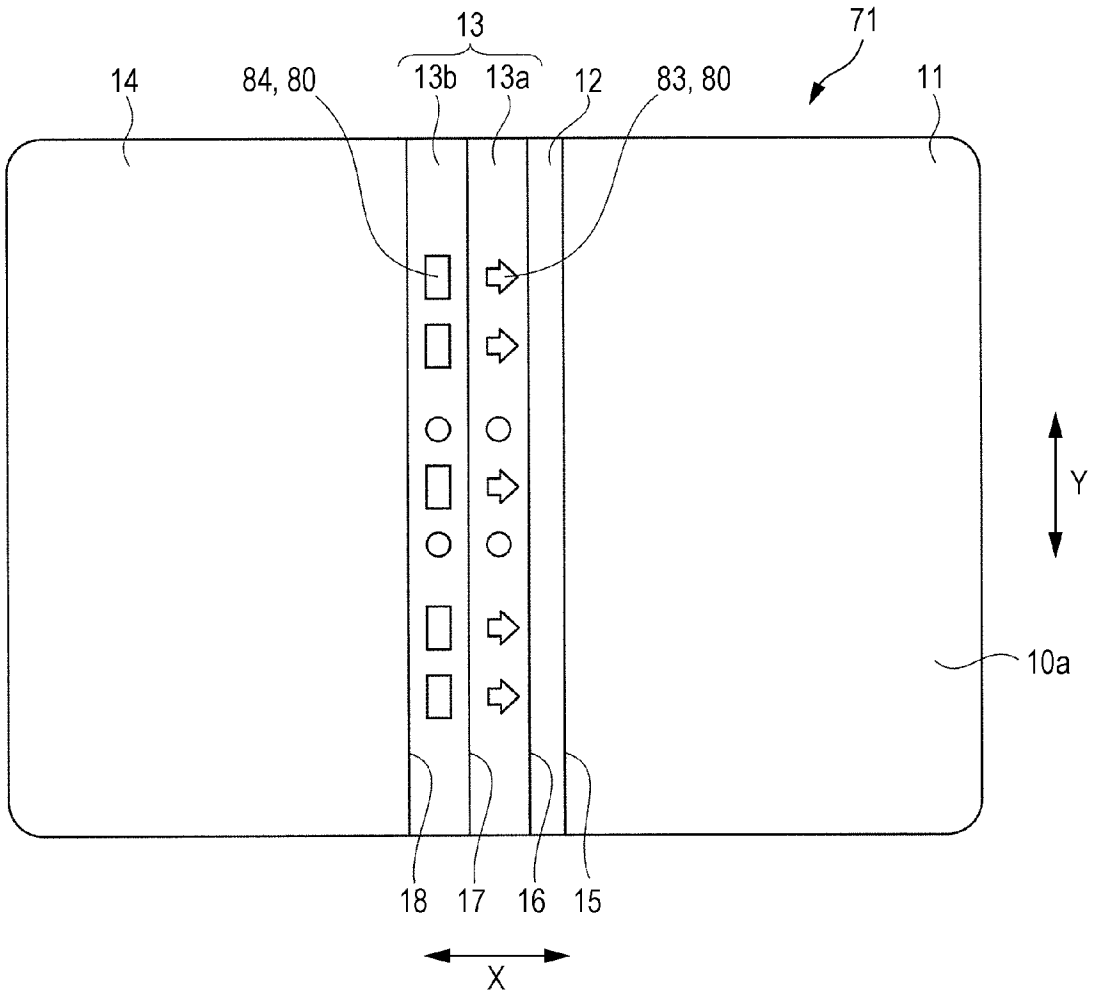
FIG. 8 is a plan view corresponding to FIG. 7 and illustrating a sheet according to a fourth modification of the first exemplary embodiment that has marks provided as autohesive members.

FIG. 8 is a plan view corresponding to FIG. 7 and illustrating a sheet 71 according to a fourth modification of the first exemplary embodiment that has marks 80 provided as autohesive members 83 and 84 instead of the marks 80 (see FIG. 7) provided as the pieces of double-sided tape 81 and 82. The sheet 71 is the same as the sheet 70, except that the marks 80 as the pieces of double-sided tape 81 and 82 are replaced with the marks 80 as the autohesive members 83 and 84. Therefore, elements of the sheet 71 that are common to those of the sheet 70 are denoted by corresponding ones of the reference numerals used for describing the sheet 70.

As illustrated in FIG. 8 the marks 80 include, for example, the autohesive members 83 and the autohesive members 84 fixed to the front side 10*a* of the sheet 71. The autohesive members 83 are provided on the first attaching portion 13*a*. The autohesive members 84 are provided on the second attaching portion 13*b*. The autohesive members 83 each have an arrow shape pointing toward the front-cover portion 11. The autohesive members 84 each have a rectangular shape.

The autohesive members 83 are positioned in such a manner as to face the autohesive members 84, respectively, when the sheet 71 is folded along the folding line 17 and the first attaching portion 13*a* and the second attaching portion 13*b* are thus superposed on each other. The autohesive members 83 and the autohesive members 84 are made of the same material. The only difference between the two is the shape thereof.

The autohesive members 83 and 84 are characterized in adhering to each other but not adhering to any material other than the material of the autohesive members 83 and 84.

If the sheet 71 according to the fourth modification described above is placed on the image forming apparatus 300 such that the side (the front side 10*a*) having the autohesive members 83 and 84 faces up (toward the near side in FIG. 8) and the autohesive members 83 having arrow shapes point in the transport direction Z of the image forming apparatus 300, printing is performed by the image forming apparatus 300 on a predetermined portion of the sheet 71 and in a predetermined orientation of the sheet 71.

Thus, the sheet 71 according to the fourth modification is placed on the image forming apparatus 300 as specified.

In the fourth modification, when the sheet 71 is folded along the folding lines 15, 16, 17, and 18, the autohesive members 83 and the autohesive members 84 closely adhere to each other, respectively. Consequently, the first attaching portion 13*a* and the second attaching portion 13*b* that have been superposed on each other are fixed to each other by the autohesive members 83 and 84.

Since the first attaching portion 13*a* and the second attaching portion 13*b* are fixed to each other while being in contact with each other, the autohesive members 83 and 84 do not appear on the outside even if the cover of the resulting flat file 100 illustrated in FIG. 1 is opened.

The sheets 10, 30, 50, 51, 70, and 71 according to the first exemplary embodiment and the modifications thereof are each applied to, for example, a sheet to be formed into the flat file 100. In general, a flat file is obtained by folding one sheet along folding lines such that at least a front cover and a back cover are provided, whereby a document or the like is allowed to be bound in a space provided between the front cover and the back cover. Hence, the sheet to be formed into a flat file only needs to include at least the front-cover portion 11 (see FIG. 1) and the back-cover portion 14. The spine portion 12 and the attaching portion 13 may be omitted.

The sheet according to the present invention is not necessarily made of a single material (paper, for example) over the entirety thereof and may be made of, for example, a cardboard including a portion made of a transparent resin sheet or the like.

The sheet according to the present invention is not limited to a cardboard.

Second Exemplary Embodiment in Which Marks are Provided on Item Other Than Flat File The present invention may be applied to a sheet to be formed into any item other than a flat file. For example, the present invention may be applied to a sheet to be formed into a box (a body portion and/or a cover portion of a box) as an exemplary packaging case.

Figure 10A:
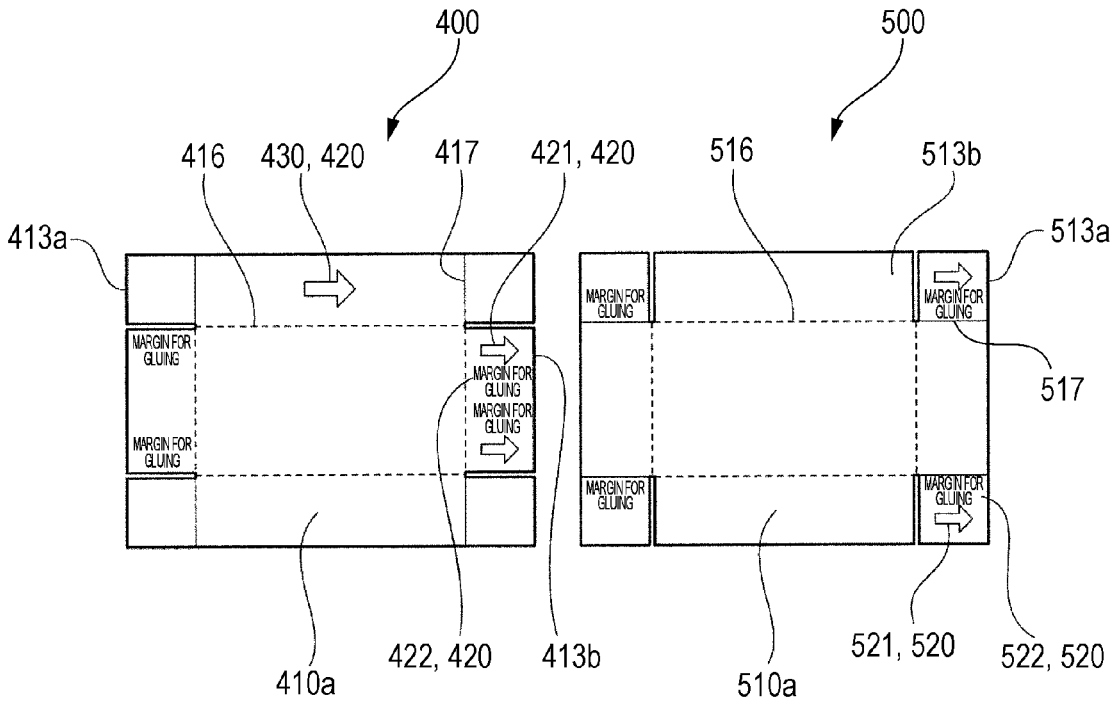
FIGS. 10A and 10B illustrate a second exemplary embodiment of the present invention that is applied to a sheet to be formed into a box as an exemplary packaging case and having marks with reference to which the sheet is placed on an image forming apparatus in a specific manner.
Figure 10B:
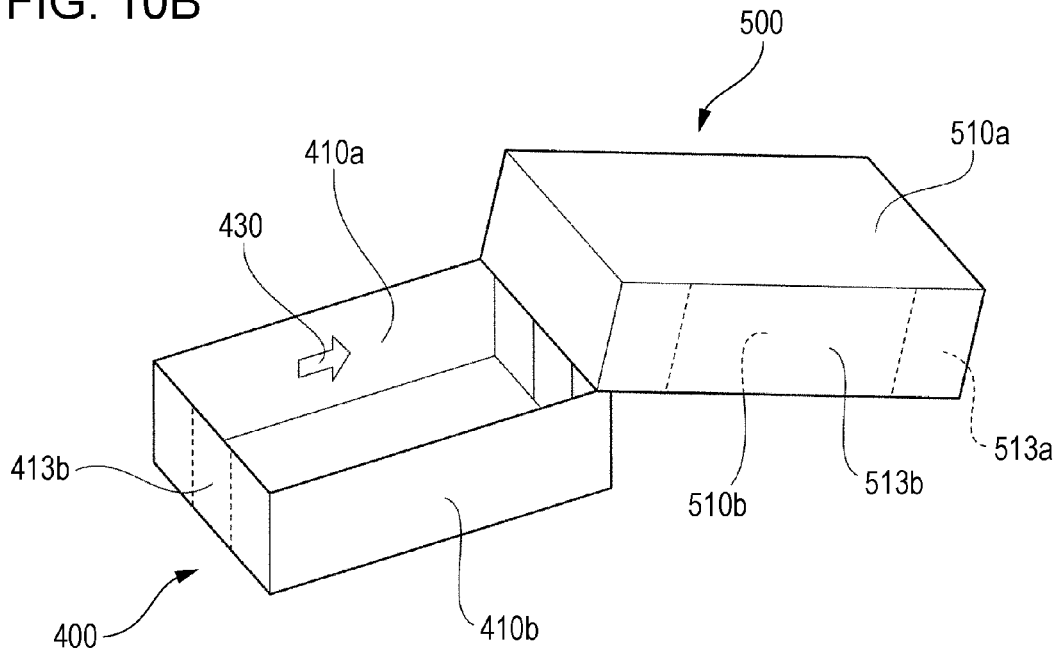

FIGS. 10A and 10B illustrate a second exemplary embodiment of the present invention that is applied to a sheet to be formed into a box as an exemplary packaging case and having marks with reference to which the sheet is placed on an image forming apparatus in a specific manner. FIG. 10A is a plan view illustrating sheets as a body box 400 and a cover box 500 that are yet to be folded and are transportable in an image forming apparatus. FIG. 10B is a perspective view of the body box 400 and the cover box 500 illustrated in FIG. 10A that are obtained by folding the sheets into three-dimensional shapes, respectively. Goods are put into the body box 400, and the cover box 500 is placed over the body box 400.

The sheet as the body box 400 has folding lines 416 and 417 intended for valley fold and includes first attaching portions 413*a* and second attaching portions 413*b*. When the first attaching portions 413*a* and the second attaching portions 413*b* are superposed on each other, the body box 400 having a three-dimensional shape is obtained. The sheet has marks 420 on a front side 410*a* thereof in areas of the second attaching portions 413*b* on which the first attaching portions 413*a* are to be superposed. Specifically, the sheet has arrow marks 421 (exemplary marks 420) indicating the direction of transport of the sheet, and character strings 422 (other exemplary marks 420) as exemplary symbols each saying "MARGIN FOR GLUING." Since the arrow marks 421 are provided in the areas on which the first attaching portions 413*a* are to be superposed, the marks 420 are concealed between portions of the sheet that come into contact with each other across the folding lines 416 and 417 in the state where the sheet is folded along the folding lines 416 and 417.

To place the sheet to be formed into the body box 400 illustrated in FIG. 10A on the image forming apparatus 300 illustrated in FIG. 3, for example, the sheet in the state illustrated in FIG. 10A is first turned over such that the arrow marks 421 point in the transport direction Z and is then placed on the image forming apparatus 300. If the sheet in this state is fed into the image forming apparatus 300, printing is performed on a back side 410*b*, illustrated in FIG. 10B, of the body box 400. If the sheet in the state illustrated in FIG. 10A is placed on the manual feed tray 310 of the image forming apparatus 300 without being turned over and is fed into the image forming apparatus 300 for printing, printing is performed by the image forming apparatus 300 on the front side 410*a*, illustrated in FIG. 10B, of the body box 400.

In the state where the sheet is folded into the body box 400 as illustrated in FIG. 10B, the front side 410*a* faces toward the inner side. That is, the arrow marks 421 are provided on a side of the sheet that is to face toward the inner side when the sheet is folded into the body box 400. In the case illustrated in FIG. 10A, an arrow mark 430 as another exemplary mark 420 is also provided on the front side 410*a*. That is, the arrow mark 430 is provided on a side of the sheet that faces toward the inner side when the sheet is folded along the folding lines 416 and 417. In this case, when the cover box 500 is provided over the body box 400, the marks 420 (including the arrow mark 430) are concealed on the inner side and are not visible to the user.

Note that either the arrow marks 421 or the arrow mark 430 only needs to be provided, and which of the marks is to be provided is determined on the basis of the side of the sheet on which printing is to be performed. In the above case, if the marks are provided in portions of the sheet that come into contact with each other when the sheet is folded into the body box 400, the marks are completely concealed. Therefore, it would be better to provide the arrow marks 421 on the second attaching portions 413*b*.

The sheet to be formed into the cover box 500 has folding lines 516 and 517 intended for mountain fold and includes first attaching portions 513*a* and second attaching portions 513*b*. When the first attaching portions 513*a* and the second attaching portions 513*b* are superposed on each other, the cover box 500 having a three-dimensional shape is obtained. The sheet has marks 520 on a front side 510*a* thereof in areas of the first attaching portions 513*a* on which the second attaching portions 513*b* are to be superposed. Specifically, the sheet has arrow marks 521 indicating the direction of transport of the sheet, and character strings 522 as exemplary symbols each saying "MARGIN FOR GLUING." Since the arrow marks 521 are provided in the areas on which the second attaching portions 513*b* are to be superposed, the marks 520 are concealed between portions of the sheet that come into contact with each other across the folding lines 516 and 517 when the sheet is folded along the folding lines 516 and 517.

To place the sheet to be formed into the cover box 500 illustrated in FIG. 10A on the image forming apparatus 300 illustrated in FIG. 3, the sheet in the state illustrated in FIG. 10A is placed on the manual feed tray 310 with the arrow marks 521 pointing in the transport direction Z. If the sheet in this state is fed into the image forming apparatus 300, printing is performed on the front side 510*a*, illustrated in FIG. 10B, of the cover box 500.

In the state where the sheet is folded into the cover box 500 as illustrated in FIG. 10B, a back side 510*b* faces toward the inner side. That is, the arrow marks 521 are provided on a side of the sheet that is to face toward the inner side when the sheet is folded into the cover box 500.

As described above, the sheet to be formed into a box as a packaging case is provided in advance with many folding lines extending in the vertical, horizontal, and oblique directions. When the sheet is folded along such folding lines, a box having a three-dimensional shape is obtained. If the second exemplary embodiment of the present invention is applied to a case where an image forming apparatus performs printing on portions of a sheet that correspond to outer sides of such a box, the sheet is placed on the image forming apparatus as specified.

The sheets 10, 30, 50, 51, 70, and 71, the sheet to be formed into the body box 400, and the sheet to be formed into the cover box 500 according to the above exemplary embodiments and the modifications thereof give visual sensation with the individual marks 20, 40, 60, 80, 420, and 520. The marks provided on the sheet according to the present invention is not limited to those giving visual sensation. Instead, the marks provided on the sheet according to the present invention may be those giving tactile sensation.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet comprising:

a folding line along which the sheet is to be folded;

at least two other folding lines, wherein the folding line is a valley folding line, and the at least two other folding lines are peak folding lines, the valley folding line being between the peak folding lines when the sheet is folded; and a mark with reference to which the sheet is placed on an image forming apparatus in a specific manner, wherein the mark is a notch provided by cutting off a portion of the sheet, and the mark is provided in an area where two portions of the sheet that are across the folding line from each other come into contact with each other when the sheet is folded along the folding line, and the mark is provided in each of areas between the valley folding line and two respective peak folding lines that are adjacent and on opposite sides of the valley folding line.

2. The sheet according to claim 1, wherein a reference for placing the sheet on the image forming apparatus that is indicated by the mark is at least one of a reference indicating which side of the sheet faces up and a reference indicating a direction of transport of the sheet.

3. The sheet according to claim 1, wherein the notch is provided at a position overlapping the folding line in such a manner as to have line symmetry with respect to the folding line.

4. The sheet according to claim 1, wherein when the sheet is folded along the folding line, the sheet is a flat file.

5. The sheet of claim 1, wherein the area in which the mark is provided does not include edge portions of the sheet.

6. A sheet comprising:

a folding line along which the sheet is to be folded;

at least two other folding lines, wherein the folding line is a peak folding line, and the at least two other folding lines are valley folding lines, the peak folding line being between the valley folding lines when the sheet is folded; and a mark with reference to which the sheet is placed on an image forming apparatus in a specific manner, wherein the mark is a notch provided by cutting off a portion of the sheet, the mark is provided in an area where two portions of the sheet that are across the folding line from each other come into contact with each other when the sheet is folded along the folding line, and the mark is provided in each of areas between the peak folding line and two respective valley folding lines that are adjacent and on opposite sides of the peak folding line.

* * * * *